US005743311A

United States Patent [19]

Crossdale et al.

[11] Patent Number: 5,743,311

[45] Date of Patent: Apr. 28, 1998

[54] LIQUID DISPENSER FOAM LIMITING ELEMENT

[75] Inventors: Garry William Crossdale, Ripley; Michael James Stevens, Derby, both of Great Britain

[73] Assignee: Diversey Lever, Inc., Plymouth, Mich.

[21] Appl. No.: 586,649

[22] PCT Filed: Jul. 15, 1994

[86] PCT No.: PCT/CA94/00380

§ 371 Date: Mar. 1, 1996

§ 102(e) Date: Mar. 1, 1996

[87] PCT Pub. No.: WO95/01934

PCT Pub. Date: Jan. 19, 1995

[30] Foreign Application Priority Data

Jul. 5, 1993 [GB] United Kingdom ..... 9313854.3

[51] Int. Cl.[6] ..... B67C 3/26

[52] U.S. Cl. ..... 141/31; 141/1; 141/286; 239/590.3

[58] Field of Search ..... 141/1.31, 286; 239/590.3

[56] References Cited

U.S. PATENT DOCUMENTS

| | | | |
|---|---|---|---|
| 2,515,600 | 7/1950 | Hayes | 261/116 |
| 2,929,567 | 3/1960 | Aghnides | 239/431 |
| 2,995,309 | 8/1961 | Moen | 239/432 |
| 2,998,930 | 9/1961 | Aghnides | 239/431 |
| 3,239,152 | 3/1966 | Bachli et al. | 239/431 |
| 3,415,294 | 12/1968 | Kelly | 141/1 |
| 3,428,258 | 2/1969 | Duggan | 239/590.3 |
| 3,642,213 | 2/1972 | Parkison et al. | 239/590 |
| 3,698,452 | 10/1972 | Waxlax | 141/286 |
| 3,707,236 | 12/1972 | Takebayasi | 210/449 |
| 3,730,439 | 5/1973 | Parkison | 239/590.3 |
| 3,757,835 | 9/1973 | Copping | 141/286 |
| 3,792,724 | 2/1974 | Hunter | 141/286 X |
| 3,805,856 | 4/1974 | McLennand | 141/286 |
| 3,974,965 | 8/1976 | Miller | 239/413 |
| 4,119,276 | 10/1978 | Nelson | 239/590.3 |
| 4,410,108 | 10/1983 | Minard | 141/286 X |
| 4,512,379 | 4/1985 | Hennig | 141/286 |
| 4,553,574 | 11/1985 | Le Donne | 141/286 |
| 4,574,853 | 3/1986 | Graffin | 141/286 |
| 4,730,786 | 3/1988 | Nelson | 239/590.3 |
| 4,958,669 | 9/1990 | Ohta | 141/31 X |
| 4,999,237 | 3/1991 | Mellors et al. | 428/280 |
| 5,008,011 | 4/1991 | Underwood | 4/615 |
| 5,094,278 | 3/1992 | Arao et al. | 141/31 X |
| 5,193,593 | 3/1993 | Denis et al. | 141/31 X |

FOREIGN PATENT DOCUMENTS

| | | |
|---|---|---|
| 0501046 | 1/1991 | European Pat. Off. . |
| 0564303 | 2/1993 | European Pat. Off. . |
| WO 9201536 | 2/1992 | WIPO . |

*Primary Examiner*—J. Casimer Jacyna
*Attorney, Agent, or Firm*—A. Kate Huffman

[57] ABSTRACT

A foam limiting element for a dispenser for liquids is provided. The element comprises a three-dimensional mesh of a multiplicity of the fibers which are connected together to create a multiplicity of irregular liquid paths through the spaces between the fibers, the element having a three-dimensional configuration to fit within a dispensing head of a dispenser. A dispenser for liquids has a dispenser head with a discharge channel in which a foam limiting element is positioned. The discharge channel has means for retaining the element in place whereby all liquid flows through the element before being dispensed. The discharge channel has a wall structure which precludes introduction of air into the liquid to be dispensed.

8 Claims, 4 Drawing Sheets

LIQUID DISPENSER FOAM LIMITING ELEMENT

FIELD OF THE INVENTION

The present invention relates to a foam control element for use in the dispensing head of a dispenser for liquids which tend to foam upon being filled into individual containers. The invention also relates to a dispenser with a foam control element.

BACKGROUND OF THE INVENTION

It is well known to dispense liquids, neat or diluted with water, from a bulk container into smaller, individual containers, for example in industrial kitchens, hotels and the like where various cleaning products are dispensed into small containers for use by individual members of the cleaning staff. An example of a dispenser for use in this fashion is described in European Published Patent Application 564,303 in the name of Diversey Corporation. The liquid being dispensed tends to foam due to agitation and turbulence, which often tends to be the case with cleaning liquids which are inherently susceptible to foaming. A problem arises in that the individual containers become partly filled with foam as the liquid is poured or dispensed into the container. Either the containers have to be only partly filled with liquid or the foam is forced to overflow while more liquid is dispensed into the container. Obviously, neither of these alternatives is at all satisfactory.

The creation of foam can to some extent be reduced by directing the flow of liquid to the side of the container, rather than in the middle where it tends to agitate the liquid already in the container. Examples of such dispensing heads are described in U.S. Pat. Nos. 3,757,835, 4,512,379 and 4,574,853. But, even this measure limits the formation of foam to only a small extent. Moreover, in many types of dispensers, it is simply not possible to direct the flow of liquid in this way.

It is also known to fit flow reducers in nozzles which dispense foaming products. Such flow reducers incorporate one or more apertured screens across the direction of flow. Examples of these types of dispensers are described in U.S. Pat. Nos. 3,698,452; 3,805,856 and 4,553,574. It has been found that these screens reduce foaming to only a limited extent and then only at relatively low delivery pressures.

There are various types of nozzle attachments for water spouts which have wire screen mesh, open cell foam, perforated plate and the like, where such attachments are designed to aerate the flow of water to minimize thereby splashing of water as it flows under pressure. Examples of such aeration devices are described in U.S. Pat. Nos. 2,515,600; 2,929,567; 2,995,309; 2,998,930; 3,239,152; 3,428,258; 3,642,213; 3,707,236; 3,730,439; 4,119,276 and 4,730,786. Although these aerator devices are useful for reducing water splashing, they are not acceptable for use as foam control devices because, by introducing air bubbles to the liquid flow, foaming of susceptible liquids would be increased.

The object of the present invention is to provide a foam control element which is relatively simple and relatively inexpensive and yet still produces a significant foam reduction effect.

Accordingly, the invention provides a foam control element comprising a three-dimensional mesh of a multiplicity of fine fibers which are connected together to create a great plurality of irregular liquid paths through the spaces between the fibers.

The invention also provides a dispenser for foaming liquids which is fitted with such a foam control element.

The inventors have found that a section of a three-dimensional mesh of fine fibers is very effective in reducing foaming of liquids being dispensed into containers. This mesh, which is commonly used for scouring pads for example, is readily available and relatively inexpensive. It might have been expected that such a mesh would have a poor effect on flowthrough of liquid, or would create blockages, but the inventors found that this was not the case. Sections of the mesh can be easily fitted in the outlet nozzles of existing dispensers and can significantly reduce foaming, thereby increasing the efficiency of the dispensers and avoiding hazardous and troublesome spillages.

SUMMARY OF THE INVENTION

In accordance with an aspect of the invention, a foam control element for a dispenser for liquids is provided. The element comprises a three-dimensional mesh of a multiplicity of fine fibers which are connected together to create a multiplicity of irregular liquid paths through the spaces between the fibers, the element having a three-dimensional configuration to fit within a dispensing head of a dispenser.

In accordance with a further aspect of the invention, a dispenser for liquids has a dispenser head with a discharge channel in which a foam control element is positioned. The discharge channel has means for retaining the element in place whereby all liquid flows through the element before being dispensed. The discharge channel has a wall structure which precludes introduction of air into the liquid to be dispensed.

In accordance with another aspect of the invention, a method of dispensing liquids from a dispenser having a foam control element comprising a three-dimensional mesh of a multiplicity of fine fibers which are connected together to create a great plurality of irregular liquid paths through the spaces between the fibers, the minimum thickness $t_{min}$ (mm) of the element being determined by the equation:

$$t_{min}=(p\times f)/_{xd}$$

where p = pressure (psi) under which liquid is dispensed f = fibre fineness (decitex)

d = density (kg/m$^3$)

x = 5, 10 or 20

The invention will be better understood from the following detailed description and the examples discussed below.

BRIEF DESCRIPTION OF THE DRAWINGS

Various embodiments of the invention are described with respect to the drawings wherein.

DETAILED DESCRIPTION OF THE PREFERRED EMBODIMENTS

The dispenser, such as described in the aforementioned European published application 564,303, comprises a dispensing head 1 controlled by a magnetically operating valve 2. Concentrate C and water W are fed to a venturi 3. In the water line there is a back flow preventer (check valve) 4.

The form of the dispenser is not central to the invention and so it will not be described in detail; the person skilled in this art will well understand the operation of this and other types of dispensers.

Figure 1:
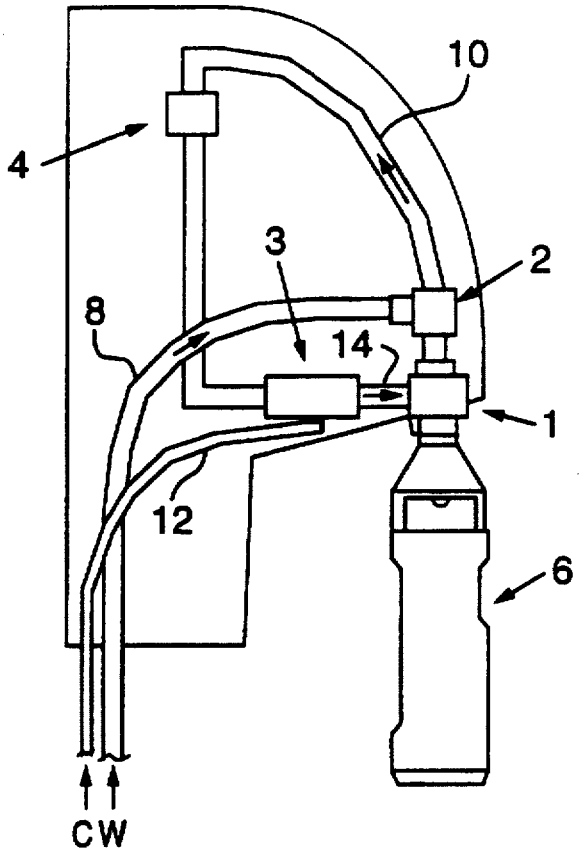
FIG. 1 is a schematic of a dispenser used for filling containers.
Figure 2:
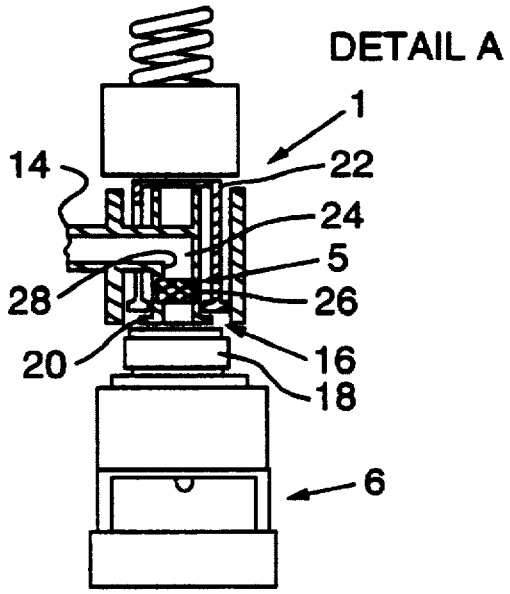
FIG. 2 is a enlarged section through the dispensing head of the dispenser of FIG. 1.

In FIG. 2 the dispensing head i is enlarged in section. The foam control element 5 is fitted at or near the outlet for the dispensing head, above bottle 6. The element diameter, according to this particular embodiment, is approximately 12 mm where it is appreciated that its dimensions may vary depending upon its application.

The valve 2 is open and closed depending upon the position of the bottle 6 which is supported by a cradle, not shown. When the bottle is empty, the cradle lifts the bottle upwardly to move the dispensing head in a direction which opens the valve 2. Water then flows in through line 8 upwardly through line 10 and through the check valve 4 back down into the venturi 3. The purposes of the venturi 3 is to draw concentrate through line 12 and mix it with the water to provide a mixed solution in line 14 which passes through the dispensing head 1. As shown in more detail in FIG. 2, the dispensing head 1 has the foam control element positioned within the discharge region generally designated 16 which is in direct fluid communication with the inlet pipe 14. As will become apparent from the following examples, the foam control element 5 is positioned in the discharge region 16 of the dispensing head to minimize the turbulence in the flow of liquid as it discharges from the dispensing head into the container 6. As will be appreciated from the relationship shown in FIG. 2, the container neck portion 18 surrounds the outlet disc 20 of the discharge region 16 when the container is pushed upwardly to contact the switch mechanism 22 which opens the flow control valve 2. The conduit 14, as it leads directly from the venturi 3 into the dispensing head 1, does not have any provision for air inlet, nor does the L-shaped channel 24 have any provision for air inlet. Hence no air is drawn into the flow of liquid above or immediately beneath the foam control element 5. Hence the dispensing head 1 is designed with the L-shaped channel 24 to ensure that no air enters the flow of liquid before flowing into the container 6. In this manner, foaming is further avoided by the failure to introduce air into the system in the region of the foam control element 5.

As will become apparent from the investigations undertaken and summarized in the following examples, there are various characteristics of the foam control element which provide this significant reduction in foam height when containers are filled with liquids which are normally susceptible to foaming during the filling operation. Although the foam control element is described in terms of the fibre structure commonly found in scouring pads, it is appreciated that the foam control element may comprise any arrangement of three-dimensional mesh of fine fibers which provide irregular-shaped channels through which the liquid must flow, as is provided in the standard type of scouring pad. The fine fibers for the three-dimensional mesh may be of plastics material, and as later defined, preferably of Nylon®. The fibers may also be of ultrafine spun glass or drawn metal wire. The fine fibers of the mesh are randomly oriented throughout the thickness of the mesh and across the surface of the mesh, such random orientation lending to the provision of the irregular-shaped channels through which the liquid must flow in being dispensed through the dispensing head. Hence the random orientation of the fibers is preferred, since it would be prohibitively expensive to provide the irregular-shaped channels with an ordered arrangement of the fine fibers. Furthermore, the random orientation of the fine fibers is further provided in that there is no predefined longitudinal shape for the fibers; that is, they can be looped, intertwined, and crossing over one another where there are few straight portions in the longitudinal direction of the fibers. Hence, the general description of the element as being a three-dimensional mesh of the fine fibers where the fibers are provided in the mesh in a random orientation.

The foam height controlling properties of the foam control element are believed to be due to this three-dimensional format of the fine fibers. Hence the fibers need not be of plastic, although plastic is preferred, and instead the fibers may be of glass or metal which are correspondingly randomly oriented to provide the same spatial characteristics of the three-dimensional mesh commonly found in scouring pads.

As will be defined in the Examples, the fineness of the fibre can be measured in Decitex units which is the weight of the three-dimensional mesh in grams when the mesh is made from 10,000 meter of the fibre. The pad thickness shall be defined in millimeters and the pad density shall be defined in kilograms per meter$^3$. Two of the characteristics of the three-dimensional pad include the ratio of the fineness of the fibre to the product of the pad thickness and pad density. A further characteristic is in determining the pad thickness by dividing the product of the pressure in pounds per square inch and fineness of the fibre by a constant times the pad density, where the constant preferably ranges in value from about 5 to about 20 depending upon the susceptibility of the liquid to foaming; i.e., ranging from a highly foaming liquid to a slightly foaming liquid.

The structural characteristics of the foam control element 5 are sufficient to ensure integrity of the three-dimensional mesh while in use. It is understood, however, that in achieving the various desired characteristics of the foam control element, the diameter or cross-sectional dimension of the foam control element may exceed its own inherent support characteristics; hence requiring a support grid or the like on the discharge side of the foam control element. Such grid, although not shown in FIG. 2, would support the foam control element when its cross-sectional dimension exceeds its own inherent ability to remain reasonably flat as captured within the dispensing head. The grid for supporting an enlarged foam control element is designed to minimize induction of turbulence into the flow after it leaves the foam control element.

It is appreciated that, from time to time, replacement of the foam control element may be required. Although not shown in FIG. 2, the discharge portion 16 of the dispensing head would be removable to allow access to the foam control elements so that it may be removed and a new one inserted in its place.

The means for retaining the foam control element in the discharge channel 24 may be a recessed groove 26 which is formed in the solid sidewalls 28 of the discharge channel. The size of the groove 26 is such to retain the foam control element in position.

EXAMPLE 1

Comparative tests were conducted on the filling of a hand dish-washing chemical diluted 1 to 10 with water ("Divoplus" available from Diversey Limited, Watford, UK) into 2 liter bottles from a standard venturi/dispensing head assembly. The water was provided at a pressure of 40 psi.

a) No foam control. Upon filling of the bottle, a very significant amount of foam was created. The height of the foam from the liquid level to the top of the bottle was 122 mm.

On inspection of the filling process, it was concluded that the high level of foam production may be due to the flow breaking up as it left the dispensing head. This resulted in the flow entering the liquid already in the bottle as a plurality of individual turbulent flows or as individual drops. This caused more air to be drawn into the liquid, resulting in more foam.

It was thought that to prevent this phenomenon occurring, the flow should be caused to enter the existing liquid in a single column, with minimum kinetic energy turbulence.

Different measures to try and achieve this were tested.

b) Flow divider. A flow divider similar to that used on domestic water taps was fitted on the outlet from the dispensing head. The divider consists of a number of thin vanes parallel to the flow, with a second set at right angles to form a grid effect. This device did improve the integrity of the flow, but no appreciable decrease in foam level was observed.

c) Plastic mesh. Two types of plastic mesh were fitted, separately, at the outlet. Both were formed of cross-members of 1 mm diameter, and the hole size was either 1.5 mm square or 3 mm square. No appreciable decrease in foam level was observed.

d) Pellets. A 15 mm section of tube filled with pellets 3 mm long and 2 mm in diameter was fitted immediately upstream of a mesh as described in test c). No significant improvement was observed.

e) Metal filter. A disc of 400 AM stainless steel mesh was fitted at the dispenser outlet. The integrity of the flow was improved but a large amount of turbulence was still seen in the liquid column leaving the outlet. There was a slight improvement in foam level: the foam height was 105 mm from the liquid level to the top of the bottle.

f) Double metal filter. Two of the discs described in test e) were used, with a spacing of 2.5 mm therebetween. There was a similar improvement in flow, but with significant turbulence being visible. There was a further slight improvement in foam level: foam height decreased to 84 mm.

g) Three-dimensional mesh of fine fibers, for example as used in scouring pads. A disc formed from a domestic scouring pad was fitted at the dispensing outlet. The liquid flow was observed to be reduced to a single column only minimal movement and turbulence could be seen in the column. The was a dramatic decrease in foam height: only 20 mm foam height was measured.

CONCLUSION: the use of a three dimensional mesh of fine fibers, for example a section of scouring pad material, can very significantly reduce the foaming of liquids dispensed into containers.

EXAMPLE 2

Comparative tests were done, using the same filling conditions as in Example 1, to determine the effect of changing the position of the fibre mesh sections relative to the dispensing outlet.

a) The pad was placed immediately downstream of the venturi, at the exit to the dispensing head. The flow path through the dispensing head was relatively tortuous. A large amount of foam was produced.

b) The pad was placed immediately upstream of a section of plastic mesh at the dispenser outlet, the mesh being as described in Example 1 c). A large amount of foam was produced.

CONCLUSION: anything downstream of the pad which increase turbulence will reduce the effectiveness of the pad; an important factor is the final surface which the liquid encounters before it leaves the dispenser and falls into the container.

EXAMPLE 3

Comparative tests were conducted to determine the effect of fibre thickness in the fibre mesh section. The filling procedure was as before, again with "Divoplus" concentrate diluted 1 to 10 with water. The tests were conducted at three different pressures, 20, 50 and 80 psi, to see if similar relative effects are achieved at various pressures. Of course, more foam was expected to be produced at increased pressures, and indeed this turned out to be the case, but reduction in foam levels even at higher pressures was hoped for with the use of the fibre mesh sections.

The liquid was delivered from the dispensing head into a measuring cylinder. The cylinder was filled with liquid and foam to the liter mark, 350 mm from the bottom. The foam was allowed to settle for a few seconds and then its height above the liquid surface was measured.

Three different sections of fibre mesh were tested, namely scouring pads available commercially as Vileda 4600, Vileda 4360 and Vileda 4370. Vileda 4600 is formed of 20 decitex fibers, 4360 is a mixture of 20 and 60 decitex fibers, and 4370 of 60 decitex fibers. The pad thicknesses were the same, approximately 9 mm, and the packing densities were approximately the same, about 160 g/m$^2$; the real density (g/m$^3$) was thus approximately 18,000 g/m$^3$.

The results of the tests are shown on FIG. 3 and are also given below.

| | | | |
|---|---|---|---|
| a) Vileda 4600: decitex | | | |
| water Pressure (Psi): | 20 | 50 | 80 |
| Foam Height (mm): | 10 | 55 | 90 |
| b) Vileda 4360: 20 and 60 decitex | | | |
| Water Pressure (Psi): | 20 | 50 | 80 |
| Foam Height (mm): | 25 | 90 | 115 |
| c) Vileda 4370: 60 decitex | | | |
| Water Pressure (psi): | 20 | 50 | 80 |
| Foam Height (mm): | 45 | 100 | 120 |

CONCLUSION: at all pressures a pad formed of finer fibers performs better than a pad of coarser fibers (pad made of fibers of different fineness are believed to behave similar to a pad with fibers of the averaged valve of the different fineness). At higher pressures, significantly more foaming occurs.

EXAMPLE 4

Comparative tests were conducted to determine the effect of the thickness of the sections of fibre mesh. Pads of Vileda 4600 were tested, at three different thicknesses. The filling conditions and other parameters were as in Example 3.

Figure 4:
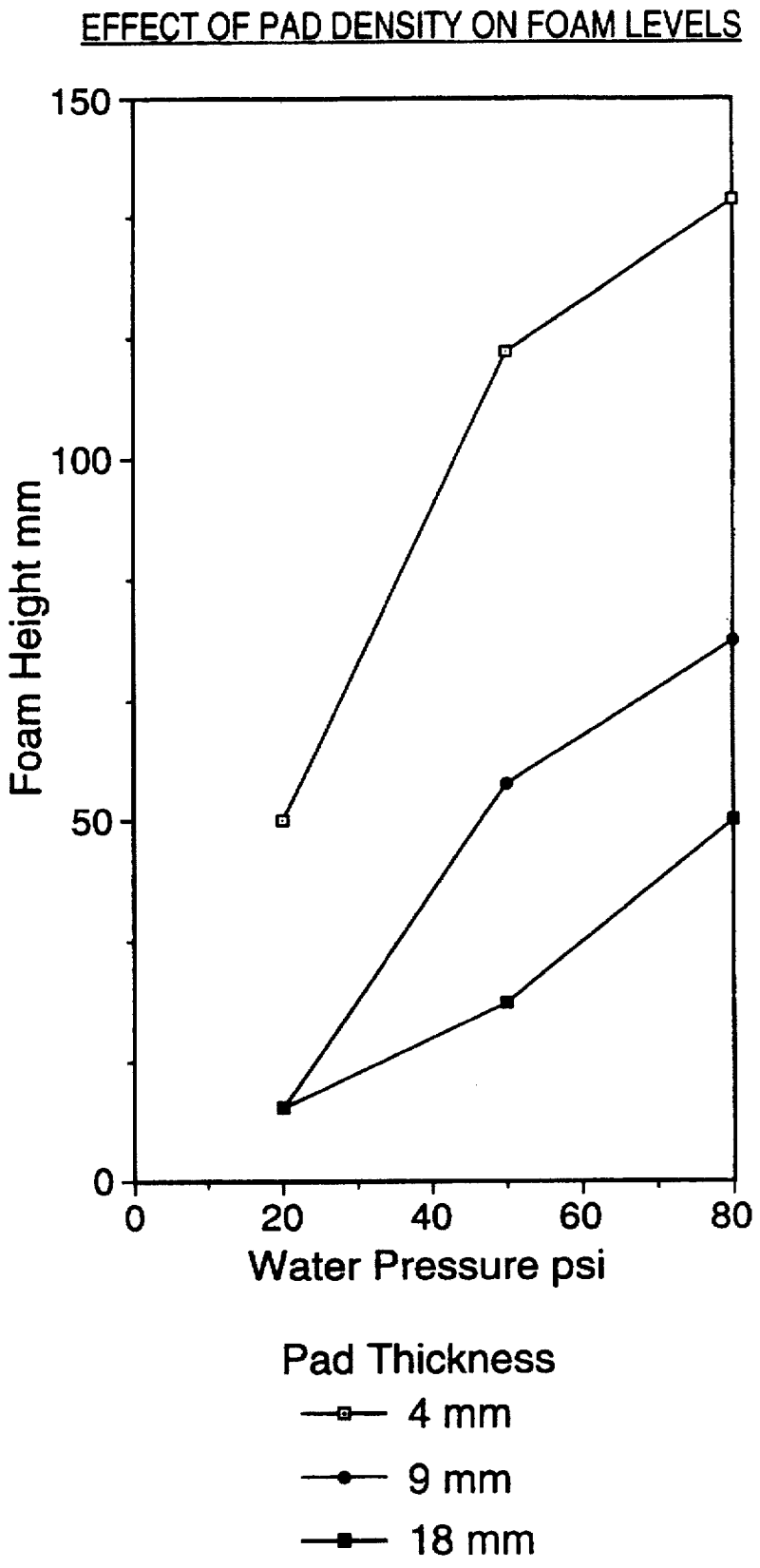
FIG. 4 is a graph showing the effect of pad thickness of the foam levels.

The results of the tests are shown in FIG. 4 and are also given below.

| | | | |
|---|---|---|---|
| a) 18 mm thickness | | | |
| Water Pressure: | 20 | 50 | 80 |
| Foam Height: | 10 | 25 | 50 |
| b) 9 mm thickness | | | |
| Water Pressure: | 20 | 50 | 80 |
| Foam Height: | 10 | 55 | 75 |
| c) 4 mm thickness | | | |
| Water Pressure: | 20 | 50 | 80 |
| Foam Height: | 50 | 115 | 135 |

CONCLUSION: the foam level decreases with increasing thickness of pad, although at lower pressures the difference between pads is slight.

EXAMPLE 5

Comparative tests were conducted to determine the effect of fibre mesh density. Pads of 9 mm Vileda 4600 were compressed to thickness of 5 mm and 2 mm in order to approximately double and quadruple the densities. The filling conditions were as before.

Figure 5:
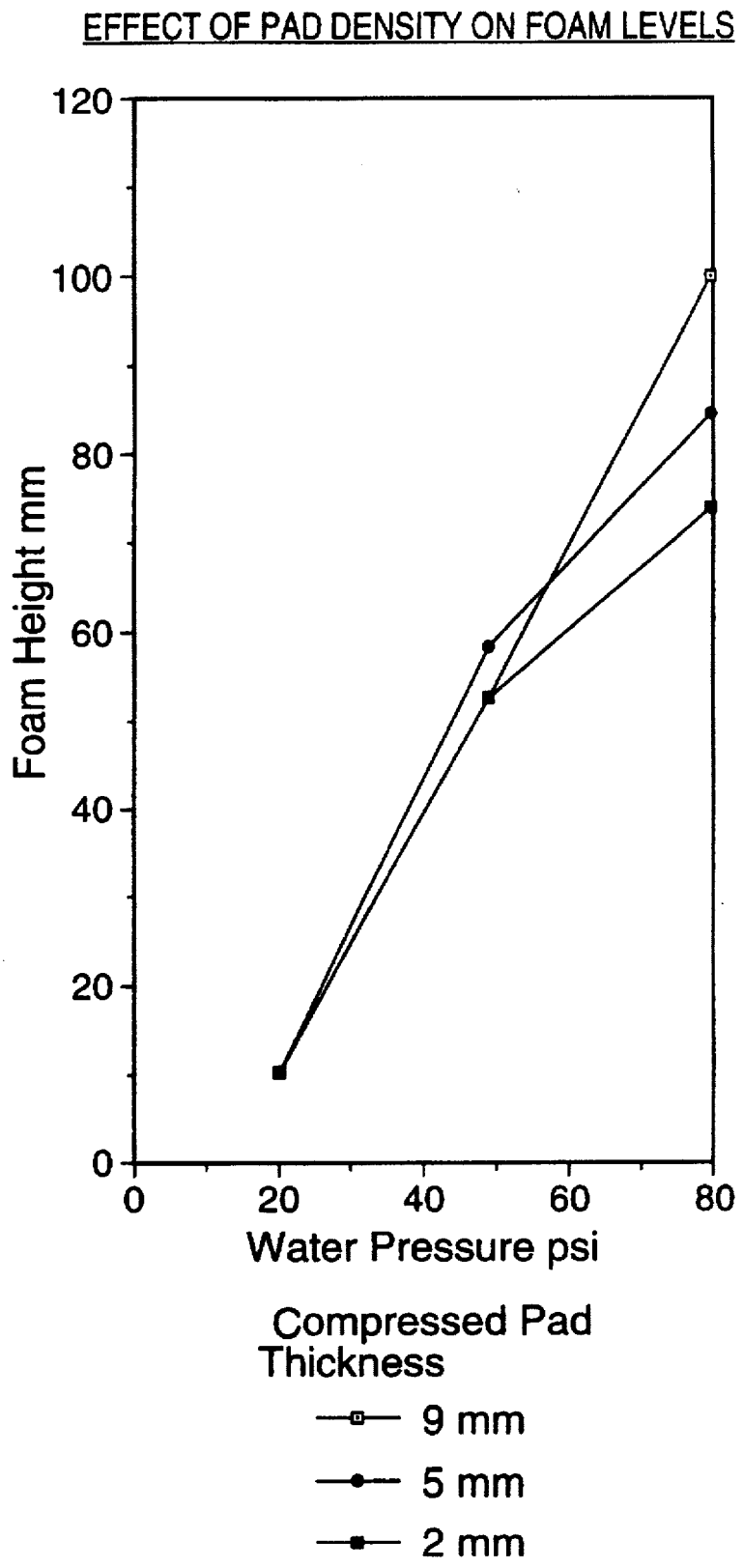
FIG. 5 is a graph showing the effect of pad density on foam levels.

The results of the tests are shown in FIG. 5 and are also given below.

| | | | |
|---|---|---|---|
| a) Single density (9 mm) | | | |
| Water Pressure: | 20 | 50 | 80 |
| Foam Height: | 10 | 65 | 110 |
| b) Double density (5 mm) | | | |
| Water Pressure: | 20 | 50 | 80 |
| Foam Height: | 10 | 70 | 95 |
| c) Quadruple density (2 mm) | | | |
| Water Pressure: | 20 | 50 | 80 |
| Foam Height: | 10 | 65 | 85 |

CONCLUSION: the increased foaming which would be expected with a smaller thickness (see Example 4) is almost entirely cancelled out by the increased density. At all except the highest of pressures, the foam levels at all three tested densities is almost the same. Taking into account the decrease in thickness, it can be concluded that increased density leads to lower foam levels.

OVERALL CONCLUSIONS a) Three dimensional meshes of fine fibers can be used to significantly reduce foam levels when filling containers.

b) Such meshes work better when formed of relatively fine fibers close together than when formed of coarser fibers further apart (i.e. for the same density, lower decitex fibers are better).

c) Increasing thickness of the mesh reduces foam levels.

d) Increasing density of the mesh (while keeping the fibre thickness constant) reduces foam levels.

e) The pressure driving the liquid through the dispenser outlet is a critical factor. To some extent, foam levels for most liquids can be controlled by operating at relatively low pressures, though even at low pressures the use of the tested pads will still reduce the foam level. Moreover, in practice, dispensers are often intended to be used over a range of pressures, depending on where the dispenser is operating, and it is not also feasible or desirable to fit pressure regulators to control the pressure.

On analyzing all of the results of the comparative tests carried out, the inventors have found that the effectiveness of the fibre mesh pads can be suitably defined by considering the ratio of the fineness of the fibre making up the mesh to the product of the mesh pad thickness and the mesh density.

Figure 3:
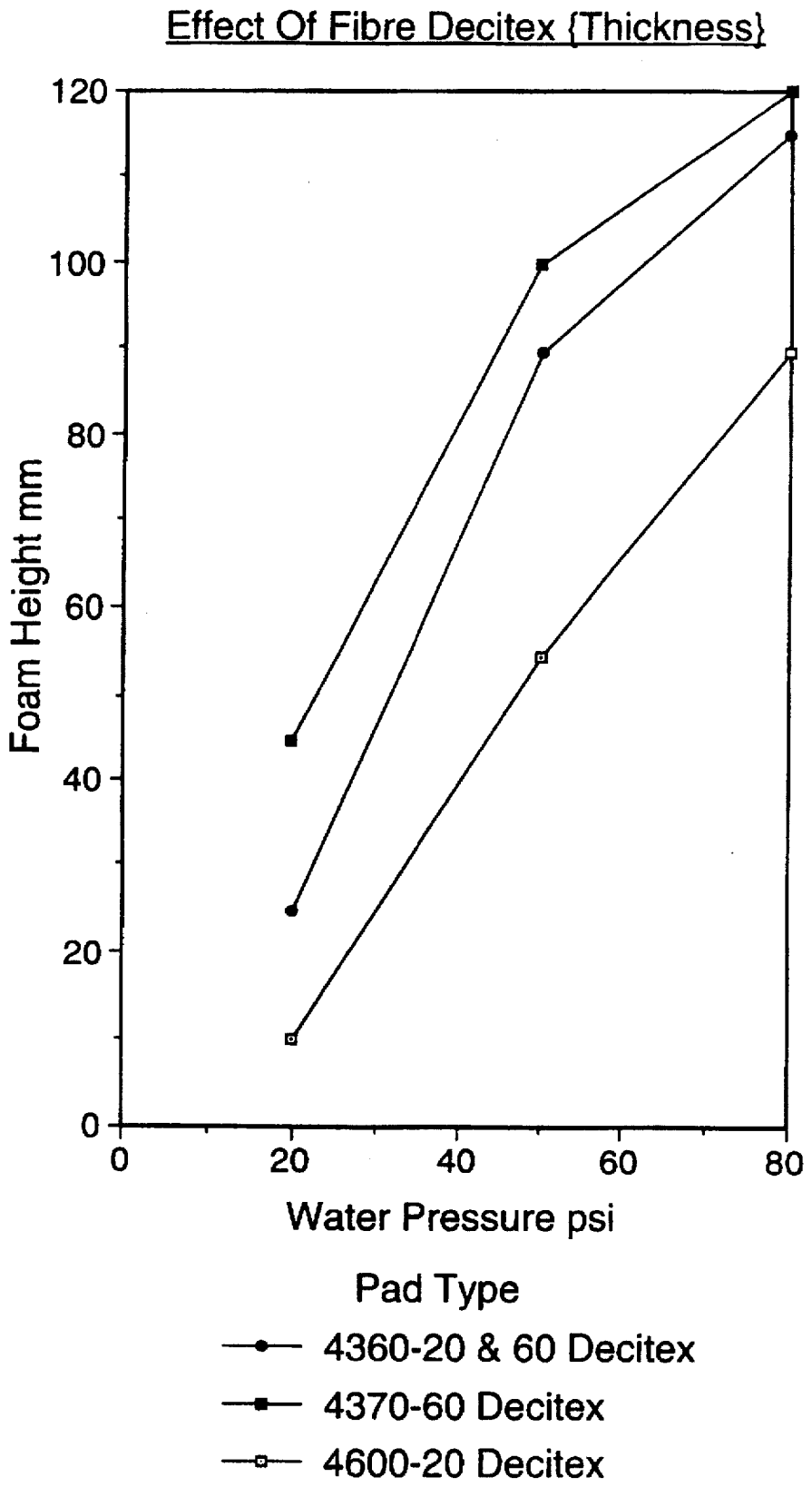
FIG. 3 is a graph showing the effect of fibre thickness on controlling foam levels.

The analysis of the ratio $f/_{txd}$ relies to some extent on assuming that the lines plotted on FIGS. 3 to 5 are linear and parallel, but it is believed that this simplification is justified.

The inventors have found that with a liquid of the type tested in the example, for a pad to work effectively in reducing foam over a range of high and low pressures, for example a range of from 20 to 80 psi, then the ratio $f/_{txd}$ should be less than 0.15.

Thus taking the pads tested in Example 3, it can be seen that with t=9 mm and d=18 kg/m$^3$, the fineness f should be less than 24 decitex.

For pads to work effectively only at lower pressures, i.e., less than 20 psi, the inventors have found that the ratio $f/_{txd}$ need not be less than 0.3.

Thus, taking again the pads tested in Example 3, it can be seen that with t=9 mm and d=18 kg/m$^3$, the fineness f should be less than 48 decitex.

In another analysis of the test results, the inventors found that on factoring in the operating pressure p (measured in psi), it was advantageous if the ratio $p \times f/_{txd}$ equalled approximately 10.

This analysis leads to a means of selecting the minimum thickness of a pad of known fineness and density f for use at a particular operating pressure. Thus, the inventors found that the minimum pad thickness could usefully be selected by considering the equation:

$$t_{min} = \frac{p \times f}{10 \times d}$$

For example, at a pressure of 20 psi, with f=20 and d=18 kg/m$^3$, $t_{min}$=2.2 mm; at 80 psi, $t_{min}$=8.8 mm.

For a pad of fineness f=60, and d=18 kg/m$^3$, $t_{min}$=6.6 mm at 20 psi and 26 mm at 80 psi.

The relationship for calculating $t_{min}$ is very useful when the parameters of the relationship are known. The maximum thickness for the foam control element is usually determined by the geometry of the dispensing head, where it is appreciated that few benefits are obtained by providing a foam control element thickness far in excess of $t_{min}$. Therefore for most dispensing head configurations and the normal range of pressure consideration, the maximum thickness of the foam control element is from approximately 10 to 50 mm.

In Example 1, it is noted that at 40 psi, the foam control element provides a foam height of only 20 mm. This result is comparable to the result obtained with the 18 mm thick element as shown in FIG. 4. The foam height with no control element was 122 mm as reported in Example 1. Hence, the foam control element reduces foam height by as much as five-sixths of the foam height in a normal uncontrolled dispensing operation. This foam height standard can be used as an alternative to the specific ratios discussed above in selecting fine fibre meshes which are useful in controlling foam. Thus, a method of selecting suitable pads of a fine fibre mesh is to select a pad thickness for a mesh of a given fineness and density which, for the operating pressure and liquid under consideration, will give up to one-sixth of the level of foam that is developed without the pad (and without other foam control mechanisms). This practical test for choosing pad parameters could be easily adopted in most dispensing and filling stations.

The comparative examples described in this application were conducted using a liquid which can be described as being moderately foamy. Obviously, there are other liquids which will be more or less foamy.

The inventors believe that liquids to be filled into containers can be broadly characterized as being either slightly foamy, moderately foamy or highly foamy. In relation to the ratios discussed above for the moderately foamy liquid, the inventors consider that they can be varied by a factor of two either way for slightly foamy and for highly foamy liquids.

Thus, for slightly foamy liquids, $f/_{t\times d}$ should be less than 0.3 for a large range of pressures or less than 0.6 for lower pressures.

For highly foamy liquids, $f/_{t\times d}$ should be less than 0.075 for a large range of pressures or less than 0.15 for lower pressures.

When selecting pad thicknesses for a given operating pressure, $t_{min}=pxf/_{20\times d}$ for slightly foamy liquids and $t_{min}=pxf/_{5\times d}$ for highly foamy liquids.

The three-dimensional meshes of fine fibers which are used in the foam control elements of the invention are preferably formed in a conventional fashion, in the same way that scouring pad material is produced. The production method is understood to consist of the carding of fibre strands into mats and the stitching together of several mats to create a thick sheet. The sheet is sprayed with a binder to fix the fibers, the spraying operation optionally including abrasive materials to give the scouring effect of the finished product. The sprayed sheets are cut up into sections when dry. It is, of course, appreciated that the abrasive materials on the fibers are not required to effect foam control in accordance with this invention.

The fibre material is routinely Nylon 66®, but it can be a different plastics material, finely spun glass fibre or finely drawn wire where suitable alternatives will be evident to the person skilled in the art. Similarly, alternative methods of forming three-dimensional meshes of fine fibers will be apparent to those skilled in the art and this invention is not limited to the meshes which are used in scouring pads.

Although preferred embodiments of the invention are described herein in detail, it will be understood by those skilled in the art that variations may be made thereto without departing from the spirit of the invention or the scope of the appended claims.

We claim:

1. A foam control element configured for use in a dispenser for liquids which tend to foam when dispensed, the element comprising a three-dimensional mesh of multiplicity of fine fibres which are connected together to create a multiplicity of irregular liquid paths through the spaces between the fibres, the ratio of the fineness f (decitex) of the fibres to the product of the element thickness t (mm) and the element density d (kg/m$^3$) being less than 0.6, said element having a three-dimensional configuration to fit within a dispensing head of a dispenser, whereby said foam control element when in use in absence of air flowing therethrough reduces foam height when a container is filled with such liquid.

2. A foam control element according to claim 1, wherein $f/_{t\times d}<0.3$.

3. A foam control element according to claim 1, wherein $f/_{t\times d}<0.15$.

4. A foam control element according to claim 1, wherein $f/_{t\times d}<0.075$.

5. A foam control element of claim 1, wherein said three-dimensional configuration is cylindrical.

6. A method of dispensing liquids from a dispenser through a foam control element for reducing foam height of liquids dispensed into a container, said element comprising a three-dimensional mesh of a multiplicity of fine fibers which are connected together to create a great plurality of irregular liquid paths through the spaces between the fibers, the minimum thickness $t_{min}$ (mm) of the element being determined by the equation:

$$t_{min}=(p\times f)/_{20d}$$

where p = pressure (psi) under which liquid is dispensed f = fibre fineness (decitex)

d = density (kg/m$^3$), said liquid being dispensed through said foam control element without introducing air to said liquid.

7. A method of dispensing liquids according to claim 6, wherein the minimum thickness of the element is determined by the equation:

$$t_{min}=(p\times f)/_{10d}.$$

8. A method of dispensing liquids according to claim 6, wherein the minimum thickness of the element is determined by the equation:

$$t_{min}=(p\times f)/_{5d}.$$

* * * * *